US009991067B2

(12) United States Patent
Faast

(10) Patent No.: US 9,991,067 B2
(45) Date of Patent: Jun. 5, 2018

(54) METHOD FOR PRODUCING AN ELECTRIC CONTACT SUPPORT

(75) Inventor: Rainer Faast, Altnagelberg (AT)

(73) Assignee: Eaton Intelligent Power Limited, Dublin (IE)

( * ) Notice: Subject to any disclaimer, the term of this patent is extended or adjusted under 35 U.S.C. 154(b) by 298 days.

(21) Appl. No.: 14/237,906

(22) PCT Filed: Aug. 13, 2012

(86) PCT No.: PCT/EP2012/065828
§ 371 (c)(1),
(2), (4) Date: May 16, 2014

(87) PCT Pub. No.: WO2013/024073
PCT Pub. Date: Feb. 21, 2013

(65) Prior Publication Data

US 2014/0237818 A1 Aug. 28, 2014

Related U.S. Application Data

(60) Provisional application No. 61/522,846, filed on Aug. 12, 2011.

(30) Foreign Application Priority Data

Aug. 12, 2011 (AT) ..... A1 181/2011

(51) Int. Cl.
*H01H 11/04* (2006.01)
*H01R 43/16* (2006.01)
(Continued)

(52) U.S. Cl.
CPC ..... *H01H 11/04* (2013.01); *H01H 11/042* (2013.01); *H01H 11/06* (2013.01); *H01R 43/02* (2013.01); *H01R 43/0263* (2013.01); *H01R 43/0482* (2013.01); *H01R 43/16* (2013.01); *H01R 43/18* (2013.01); *H01R 43/26* (2013.01);
(Continued)

(58) Field of Classification Search
CPC ..... H01H 11/04; H01H 11/042; H01H 11/06; H01H 2011/067; H01R 43/0482; H01R 43/16; H01R 43/18; H01R 43/26; H01R 43/02; H01R 43/0263; Y10T 29/49121; Y10T 29/49208; Y10T 29/49213; Y10T 29/49179
See application file for complete search history.

(56) References Cited

U.S. PATENT DOCUMENTS 3,164,708 A 1/1965 Theobald
3,502,836 A 3/1970 Woolley
(Continued)

FOREIGN PATENT DOCUMENTS

DE 701293 C 1/1941
GB 2072057 A 9/1981
JP 06060925 A * 3/1994

*Primary Examiner* — A. Dexter Tugbang
(74) *Attorney, Agent, or Firm* — Leydig, Voit & Mayer, Ltd.

(57) ABSTRACT

A method for the production of an electric contact carrier includes producing a basic profile from a basic material. A contact material is applied on a contact accepting area of the basic profile. The contact material is formed into a contact of the contact carrier. Then, the contact carrier is removed from the basic material.

6 Claims, 1 Drawing Sheet

(51) Int. Cl.

| | |
|---|---|
| ***H01H 11/06*** | (2006.01) |
| ***H01R 43/048*** | (2006.01) |
| ***H01R 43/18*** | (2006.01) |
| ***H01R 43/26*** | (2006.01) |
| ***H01R 43/02*** | (2006.01) |

(52) U.S. Cl.
CPC ... *H01H 2011/067* (2013.01); *Y10T 29/49121* (2015.01); *Y10T 29/49179* (2015.01); *Y10T 29/49208* (2015.01); *Y10T 29/49213* (2015.01)

(56) References Cited

U.S. PATENT DOCUMENTS

| | | | | | |
|---|---|---|---|---|---|
| 3,995,365 | A * | 12/1976 | Repplinger | H01H 11/042 | 29/622 |
| 4,253,234 | A * | 3/1981 | Niles | H01R 43/16 | 29/876 |
| 5,671,531 | A * | 9/1997 | Mugiya | Y10T 29/49121 | 257/E21.525 |
| 2003/0049975 | A1 * | 3/2003 | Tsuji | H01R 43/16 | 439/843 |
| 2003/0220015 | A1 * | 11/2003 | Ishiyama | H01R 43/16 | 439/595 |
| 2010/0035485 | A1 * | 2/2010 | Okamura | H01R 43/16 | 439/877 |

* cited by examiner

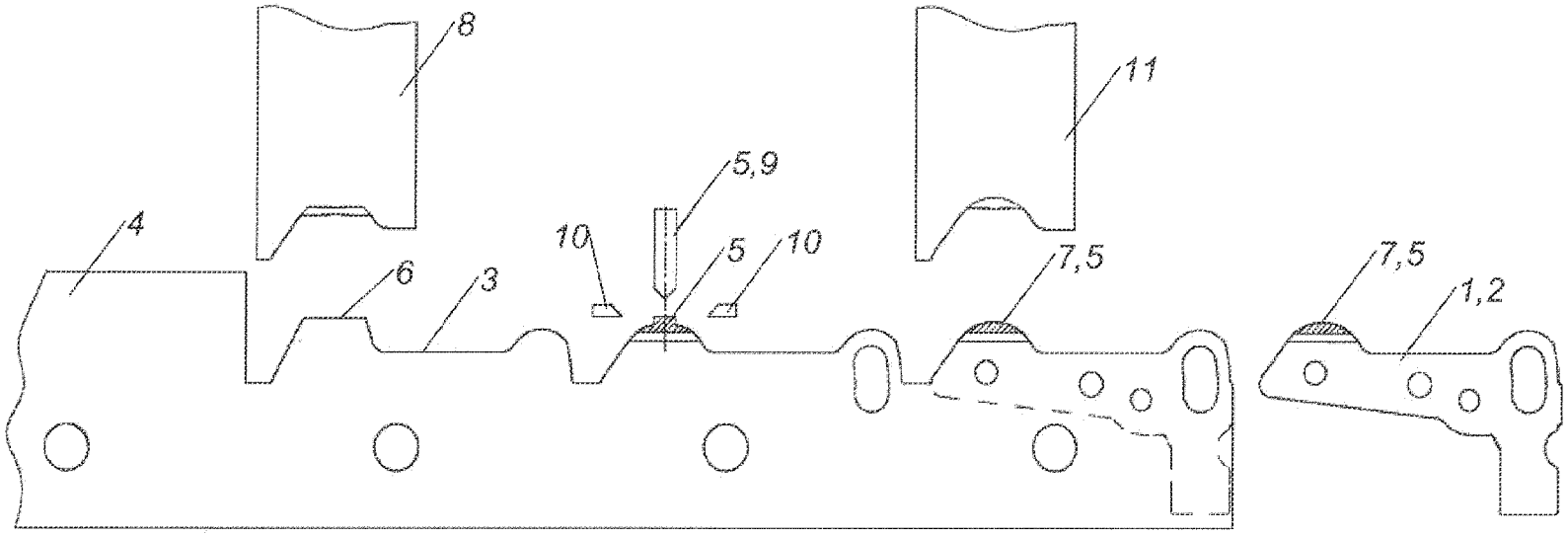
1,2
7,5
11
7,5
10
5,9
5
10
8
3
6
4

METHOD FOR PRODUCING AN ELECTRIC CONTACT SUPPORT

CROSS-REFERENCE TO PRIOR APPLICATIONS

This application is a U.S. National Phase Application under 35 U.S.C. § 371 of International Application No. PCT/EP2012/065828, filed on Aug. 13, 2012, and claims benefit to U.S. Provisional Patent Application No. 61/522,846, filed on Aug. 12, 2011 and Austrian Patent Application No. A1181/2011, filed on Aug. 12, 2011. The International Application was published in German on Feb. 21, 2013 as WO 2013/024073 A1 under PCT Article 21(2).

FIELD

The invention relates to a method for producing an electric contact carrier.

BACKGROUND

Electric contacts are provided in electric switching devices in order to close and/or keep closed a current path through the switching device, or to open it and/or keep it open. The respective contacts are here arranged on mobile or fixed contact carriers, perhaps also fixed at the housing. This separate embodiment of the contact on a contact carrier has become common due to the extensive requirements set for contacts. During switching processes, brief events of electric arcs occur, and thus material is removed, and the material is subjected to high thermal stress. Additionally, the contacts are exposed to environmental influences and they shall demonstrate good electric features over an extended period of time, which however may be compromised by oxide layers. The contacts are therefore produced from particular materials in order to meet the respectively high requirements. Common contact materials for electric contacts include precious metals, such as silver or gold. These materials are rare and expensive.

It is known to produce contact carriers, with the contact carriers being made from copper and/or a copper alloy, on which an electric contact comprising a silver alloy and/or a gold alloy is arranged. In accordance with common method, it is provided here to produce the contact carriers from an expensive blank in the form of a bi-metal comprising a copper alloy for the contact carrier and a precious metal alloy as the contact material for the actual contact. Here, a large portion of the precious metal alloy is removed from the blank due to the production method used. Here it is provided, for example, that the majority of the precious metal alloy is removed from the area which shall form the contact itself using a punching process. However, by this economical production technology the area of the contact to be formed is stressed to such an extent that in spite of subsequent embossing steps at the edges of the contact, quality problems can arise, which require appropriate quality assurance steps in this area and lead to high rejection ratios.

SUMMARY

In an embodiment, the present invention provides a method for the production of an electric contact carrier. A basic profile is produced from a basic material. A contact material is applied on a contact accepting area of the basic profile. The contact material is formed into a contact of the contact carrier. Then, the contact carrier is removed from the basic material.

BRIEF DESCRIPTION OF THE DRAWINGS

The present invention will be described in even greater detail below based on the exemplary FIGURE. The invention is not limited to the exemplary embodiment. All features described and/or illustrated herein can be used alone or combined in different combinations in embodiments of the invention. The features and advantages of various embodiments of the present invention will become apparent by reading the following detailed description with reference to the attached drawing which illustrates the following:

The FIGURE shows an area of a production arrangement for producing contact carriers 1 in accordance with a method according to an embodiment of the present invention.

DETAILED DESCRIPTION

In an embodiment, the present invention provides a method in accordance with the type mentioned at the outset by which the above mentioned disadvantages can be avoided, the expenses at the contact material can be reduced, and the production quality of the contacts can be increased.

This way, a contact carrier with an electric contact can be formed with only little discarded contact material developing. By the economical use of a contact material generally comprising at least one precious metal the costs for a finished contact carrier can be considerably reduced. Additionally, this way valuable and rare resources can be saved. By omitting the punching process of the contact material in the area of the contact to be formed additionally the production quality can be considerably increased in this area, which reduces the rejection rates and the required quality assurance measures to be implemented. This can lead to lower production expenses and increased quality.

With reference to the enclosed drawing, which merely shows a preferred embodiment in an exemplary manner, the invention is described in greater detail. Here the single FIGURE shows an area of the production of a contact bridge in accordance with a preferred embodiment of the method.

The FIGURE shows an area of a production arrangement for producing contact carriers 1 in accordance with a method according to an embodiment of the present invention, with here a basic profile 3 being produced from a basic material 4, with subsequently a contact material 5 being applied on the contact accepting area 6, subsequently the contact material 5 is formed into a contact 7, and then the contact carrier 1 is removed from said basic material 4.

This way the contact carrier 1 can be formed with an electric contact 7, with only little discarded contact material 5 developing. By the economical use of the contact material 5, generally comprising at least one precious metal, the costs for a finished contact carrier 1 can be considerably reduced. Additionally, this way valuable and rare resources can be saved. By omitting a punching process of the contact material 5 in the area of the contact 7 to be formed additionally the production quality can be considerably increased in the area, thus reducing the rejection ratio and allowing to lower the quality assurance measures to be implemented. This can lead to lower production expenses and increased quality.

The single FIGURE shows a detail of a production arrangement, in which a type of pipe-lining is performed, respectively one processing step at the very same basic material 4, which is moved between the processing steps to the next tool arranged downstream, if applicable.

The method according to an embodiment of the present invention is provided for the production of a contact carrier 1, which here my represent any type of contact carrier 1 of a switching device, thus a device directly carrying and/or comprising an electric contact. It is particularly preferred for the contact carrier 1 to represent a switching bridge 2 of a safety switching device, particularly a circuit breaker and/or an overload switch. Particular requirements are set for switching bridges 2 of such circuit breakers, because in case of short circuitry they must open circuits allowing currents to flow at a strength of several thousand amperes.

The contact carrier 1 is made from the basic material 4, except for the contact 7 itself. The basic material 4 here represents a blank, from which the contact carrier 1 is produced, and which is essentially made from said material. It is preferably provided for the basic material 4 to include a considerable copper content. Preferably the basic material 4 represents a metal tape and/or metal block of sufficient thickness.

Here, the contact 7 shall be considered an area of the contact carrier 1, which is provided and embodied to come into physical contact with another component within an electric switching device, and this way forms an electrically conductive connection. The contact 7 is generally easily identified by its shape and its exposed and/or projected arrangement at the contact carrier 1. Additionally, the contact 7 is formed from a contact material 5, which is distinguished from the material 5 of the basic material 4. It is preferably provided for the contact material 5 to comprise precious metal, particularly silver and/or gold, with it further may be provided that the contact material 5 comprises copper.

It is provided that a basic profile 3 is produced from the basic material 4. The basic profile 3 preferably forms the contour of the contact carrier 1 at least at one side, particularly the side at which the contact 7 will be formed. It may be provided to form the basic profile 3 from the basic material 4 using various methods, for example cutting methods, such as grinding or filing. It is preferably provided for the basic profile 3 to be produced in a method, which abstains from removing material, particularly by way of punching and/or embossing, from the basic material 4. Such methods show particular advantages in mass production. The FIGURE shows the basic material 4 with the basic profiles 3 already produced.

After the production of the basic profile 3 it is provided for a contact material 5 to be applied on a contact accepting area 6.

Here, the contact accepting area 6 marks an area at which the electric contact 7 shall be arranged. It may be provided here that the contact accepting area 6 is already formed during the production of the basic profile 3. It is preferably provided that after the production of the basic profile 3 the contact accepting area 6 is formed at the basic profile 3, by way of embossing and/or upsetting. This way the contact accepting are 6 can be adjusted with regards to size and/or surface structure simply and easily to additional specifications. The single FIGURE shows at the left side an already finished basic profile 3 with an embossing plunger 8 prior to the production of the contact accepting area 6.

As already shown, it is subsequently provided to apply a contact material 5 on the contact accepting area 6. By the fact that the contact material 5 is only applied on the contact accepting area 6 any excessive material consumption can be avoided in this area. Here, different methods may be provided in order to apply the contact material 5 on the contact accepting area 6 and permanently connect it thereto, for example by way of welding, soldering, or riveting.

Here it is preferably provided that the contact material 5 is welded to and/or onto the contact accepting area 6, allowing the technical production to be easily automated, creating a secure and lasting connection between the contact material 5 and the contact accepting area 6. Here, different welding methods may be used.

Depending on the way the contact material 5 is connected to the contact accepting area 6 different types of providing the contact material 5 may be particularly advantageous.

It is preferably provided for the contact material 5 to be applied as a wire-shaped contact material 5 on the contact accepting area 6. This yields a particularly advantageous option, when welding the contact material 5 to the contact accepting area 6, to use the wire-shaped contact material 5 as the welding rod, and to waive any retrofitting of existing welding robots here.

The term "wire-shaped" here defines a metal strand, with its mean cross-sectional dimension is considerably smaller than its longitudinal extension, at least during and/or after its production. The wire-shaped contact material 5 may show any arbitrary cross-section, with here it preferably being provided that the wire-shaped contact material 5 shows a round, elliptic, or rectangular cross-section. However, more complex geometric cross-sections may also be used. Particularly preferred it is provided that the cross-section of the wire-shaped contact material 5 is selected such that the subsequent shaping of the contact is supported by more contact material being arranged accordingly, based on the shape of the cross-section at areas where more contact material is required, and vice versa. This may be achieved for example by serrated, toothed, or sinusoidal recesses at the edge of the cross-section of the wire-shaped contact material 5. For example, a cross-sectional profile may be provided in accordance with a torx wrench.

The single FIGURE shows symbolically a detail of the wire-shaped contact material 5 above a contact 7, already welded thereat but not yet finally finished.

In particular when applying the contact material 5 as a wire-shaped contact material 5 perhaps slightly more contact material 5 can be applied on the contact accepting area 6 than actually required. Due to the fact that this may have negative consequences, in accordance with a preferred embodiment of the method, it is provided that, after the application of the contact material 5 on the contact accepting area 6, any excess contact material 5 is removed. The single FIGURE shows the knives of a separating device 10 in a stylized fashion. The contact material 5 separated here still comprises the pure contact material 5, which simplifies the recycling of said contact material 5.

After the contact material 5 has been applied, and perhaps any access contact material 5 has been removed, it is provided for the contact material 5 to be shaped to a contact 7. Here, the applied contact material 5 is deformed such that it complies with the particular requirements of the design of electric contacts 5. For this purpose different mechanic methods may be provided, such as cutting or etching. In accordance with a preferred embodiment of the method, it is provided that the applied contact material 5 is formed into a contact 7 by way of embossing. This represents a particularly easily automated method, by which a permanently good quality can be yielded. For this purpose, the FIGURE shows an appropriate contact embossing plunger 11. Due to the applied contact material this embossing process can occur with considerable better (quality) and much lower rejection ratios than the method described at the outset.

Finally it is provided that subsequently the contact carrier 1 is removed from the basic material 4. To this regard it is particularly provided for the contact carrier 1 to be punched out of the basic material 4. The FIGURE shows the basic material 4, with the contour of the contact carrier 1 being indicated in dot-dash lines underneath the contact embossing plunger 11, as well as a punched out, finished contact carrier 1 at the right next to the basic material 4.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A method for the production of an electric contact carrier of a switching bridge, the method comprising:

producing a basic profile from a basic material, the basic profile including a contact accepting area;

welding a portion of a contact material on the contact accepting area of the basic profile; and then cutting a remaining portion of the contact material from the welded portion after the contact material is welded to the contact accepting area;

forming the welded portion of the contact material into a contact of the electric contact carrier; and then removing the electric contact carrier from the basic material.

2. The method in accordance with claim 1, wherein the basic profile is at least one of punched and embossed from the basic material.

3. The method in accordance with claim 1, wherein the contact accepting area is formed at the basic profile by at least one of embossing and upsetting.

4. The method in accordance with claim 1 wherein the contact material is applied as a wire-shaped contact material on the contact accepting area.

5. The method in accordance with claim 1 wherein the contact material is formed into the contact by embossing.

6. The method in accordance with claim 1 wherein the contact carrier is embossed from the basic material.

* * * * *